United States Patent [19]

Jacob

[11] 3,948,447

[45] Apr. 6, 1976

[54] PROCESS AND ARRANGEMENT FOR THE REGENERATION OF FOUNDRY SAND

[76] Inventor: Hermann Jacob, Fachenfelderweg 115, 2105 Seevetal (Horst), Germany

[22] Filed: Aug. 7, 1974

[21] Appl. No.: 495,524

[52] U.S. Cl. ..... 241/5; 241/19; 241/24; 241/51; 241/142; 241/DIG. 10

[51] Int. Cl.[2] ..... B24C 19/00

[58] Field of Search ..... 241/DIG. 10, 5, 19, 24, 241/25, 27, 51, 60, 73, 84, 86, 138, 142, 40; 51/9 R, 325, 281 R

[56] References Cited

UNITED STATES PATENTS

| | | | |
|---|---|---|---|
| 1,634,385 | 7/1927 | Rapp | 241/DIG. 10 |
| 1,988,473 | 1/1935 | Bennett | 241/138 X |
| 2,233,728 | 3/1941 | Bell | 241/DIG. 10 |
| 2,304,882 | 12/1942 | Burg | 241/DIG. 10 |
| 2,707,314 | 5/1955 | Horth | 241/DIG. 10 |
| 3,829,029 | 8/1974 | Carpenter | 51/9 R X |

*Primary Examiner*—Donald G. Kelly
*Attorney, Agent, or Firm*—Michael J. Striker

[57] ABSTRACT

Used foundry sand which is predominantly in the form of lumps containing a binder for the sand particles is regenerated. In the course of the regeneration, the lumps are comminuted and, simultaneously therewith, an at least partial separation of the sand and the binder is effected. The simultaneous comminution and separation is effected by a dry, mechanical procedure during which the lumps are subjected to an abrasive or scouring action. This is accomplished by means of a pair of vibrating or rotating brush-like members provided with steel bristles. These members are located adjacent the bottom of a trough-shaped strainer which permits the passage of sand particles having a size less than a predetermined size. A cover is provided for the strainer and serves to cause rebounding of particles which impinge upon it. A feed hopper feeds the lumps of used foundry sand to the brush-like members and a bar overlying the gap between the latter prevents entry of the lumps into the gap. A housing surrounds the brush-like members and the feed hopper, and dust-like material is withdrawn from the housing by suction. A chute located beneath the strainer serves to convey sand particles which have passed through the latter from the housing.

14 Claims, 3 Drawing Figures

PROCESS AND ARRANGEMENT FOR THE REGENERATION OF FOUNDRY SAND

BACKGROUND OF THE INVENTION

The invention relates generally to the preparation of materials to be used in particulate form, the term "preparation" as used herein being understood to emcompass "regeneration". Of particular interest to the invention is the treatment of used foundry sand.

The cleansing or treatment of the used sand generated in very large quantities in foundries after each molding or casting operation is a problem which has not yet been satisfactorily solved. This used sand is primarily present in bulky form, that is, in the form of lumps and the like which are sometimes of substantial dimensions. These lumps must be comminuted and the sand particles finally obtained then freed from the coating of binder which surrounds them. The binder in the used foundry sand constitutes a contaminant for the sand and as used herein, the term "contaminant" will be understood to include the binder present in the used foundry sand. Various apparatus such as ball mills, crushers, hammer mills and the like are used for the purpose of comminuting the hard lumps. The removal of the binder coating from the sand particles is performed subsequent to the comminution of the lumps using various methods such as mechanical, pneumatic, thermal or chemical processes.

The above manner of treating used foundry sand is a complicated one and, hence, is expensive. Moreover, the results obtained are often unsatisfactory, this being particularly true in those cases where the binder to be removed is one based on synthetic resins such as, for example, furan resins.

SUMMARY OF THE INVENTION

It is, accordingly, a general object of the invention to provide a novel process and arrangement for the preparation of materials to be used in particulate form.

Another object of the invention is to provide a process and arrangement for the preparation of materials to be used in particulate form which permit such preparation to be achieved more simply than was possible heretofore.

A further object of the invention is to provide a process and arrangement for the preparation of materials to be used in particulate form which enable such preparation to be achieved more economically than was possible until now.

An additional object of the invention is to provide a process and arrangement for the preparation of materials to be used in particulate form which enable more satisfactory results than heretofore to be achieved.

It is also an object of the invention to overcome the prior art disadvantages associated with the treatment of used foundry sand outlined above.

In accordance with the listed objects and others which will become apparent hereinafter, the invention provides, in a process for the preparation of a material to be used in particulate form with a first range of particle sizes from starting particles with a second range of larger particle sizes and which include the aforementioned material and another substance at least partially surrounding the latter, the improvement which comprises comminuting the starting particles and simultaneously effecting at least partial removal of the aforementioned substance from the aforementioned material in the starting particles.

The invention is eminently suitable for the treatment of used sand generated in foundries and the starting particles may comprise used foundry sand which may be predominantly in the form of lumps. Where the starting particles include used foundry sand, the substance which at least partially surrounds the sand in the starting particles may comprise a binder for the sand.

According to the invention, the simultaneous comminution and removal are advantageously effected by a mechanical treatment which is preferably performed dry. The simultaneous comminution and removal may comprise subjecting the starting particles to an abrasive, rubbing or scouring action and this may be accomplished by subjecting the starting particles to the action of at least one brush-like member.

The starting particles may be subjected to an abrasive treatment by means of a plurality of brush-like members. Advantageously, the brush-like member or members are driven for the purpose of obtaining a relative motion between the same and the starting particles. It is favorable when the process of the invention is carried out using rotating or vibrating brush-like members and, preferably, the brush-like members are provided with steel bristles.

The invention further provides, in an arrangement for the preparation of a material to be used in particulate form with a first range of smaller particle sizes from starting particles with a second range of larger particle sizes and which include the aforementioned material and another substance at least partially surrounding the latter, particularly for use in the regeneration of used foundry sand, the improvement which comprises means for comminuting the starting particles and for simultaneously effecting at least partial removal of the aforementioned substance from the aforementioned material in the starting particles.

It may be seen that the invention encompasses an arrangement which may be used for carrying out the process of the invention. According to one preferred embodiment of the invention, the arrangement includes a somewhat trough-shaped container having a perforated bottom and perforated walls and provided with perforations of sufficient size to permit passage therethrough of particles having a size in the aforementioned first range of smaller particles such as, for instance, sand particles. A cover is provided for the trough-shaped container or strainer and serves as a deflecting or bounce plate, that is, the cover is constructed so as to cause particles impinging thereupon to rebound. In the preferred embodiment being presently described, the comminuting and removing means comprises a pair of rotatable brush-like rollers provided with steel bristles and arranged interiorly and adjacent the bottom of the strainer. A feeding hopper for the material to be treated, that is, for the starting particles, extends to a location directly adjacent the bristles of the brush-like rollers accommodated in the trough-shaped strainer or, in other words, the outlet end of the feeding hopper is located directly adjacent these brush-like rollers. Advantageously, the feeding hopper has a substantially conical cross-section or is of substantially funnel-shaped configuration. A gap is defined intermediate the brush-like rollers and, in order to prevent entry of the starting particles into this gap, a retaining bar is provided and at least partially overlies this gap. A housing surrounds the trough-shaped strainer and is provided with connections which enable communication between the interior of the housing and a source of suction to be achieved so as to permit the removal of dust-like material from the housing.

It is particularly advantageous, in accordance with the invention, for the pair of brush-like rollers to comprise a support or shaft constituting a roller axis and on which there are arranged discrete sheet-like elements provided with bristles, that is, brush elements, with the elements being interchangeably or removably mounted on the shaft. Preferably, the sheet-like elements are of disc-shaped configuration.

By virtue of the invention there has been created a process and an arrangement which enable larger particles such as, for example, the lumps of used sand generated in foundries, to be reduced in size while, simultaneously, permitting a very intensive cleansing removal of the binder layer surrounding the sand particles to be achieved. Thus, by means of the arrangement and the process utilized herein, a mechanical reduction in size of the lumps and a purely mechanical regeneration of the sand may be realized. In particular, the used sand arising from the mold and core production processes such as the Croning process with furan resin, the hot-box process and the coldbox process, to name only a few utilizing binders having very good ductility properties which cannot, or only with very great difficulty, be removed with pneumatic methods, undergoes an intensive cleansing in accordance with the invention by virtue of the brushing and scrubbing treatment. Since the resulting sand particles are intensively treated, the arrangement according to the invention is also well-suited as a preliminary stage for a subsequent pneumatic or thermal treatment of the used sand should this be desirable.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
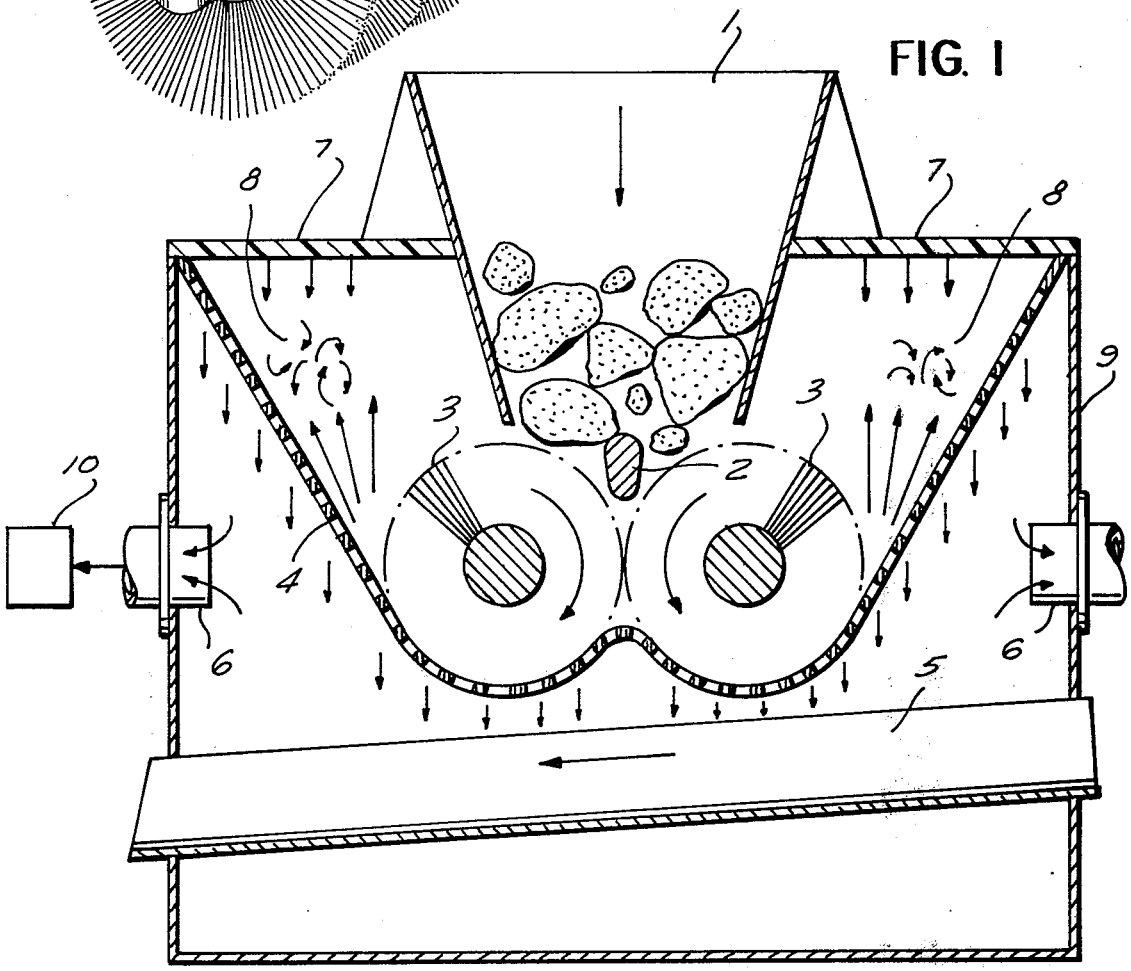
FIG. 1 is a schematic representation in form of a vertical section of one form of an arrangement according to the invention which may be used for carrying out the process of the invention.

Referring initially to the FIG. 1, it may be seen that the arrangement illustrated therein includes a container 4 which is here shown as being of somewhat trough-shaped configuration. The container 4 has a perforate bottom as well as perforate side walls and the dimensions of the perforations are chosen in such a manner that they are of sufficient size to permit passage therethrough of particles which have been cleaned and are of the desired dimensions. Thus, the container 4 functions as a strainer or sieve.

A pair of brush-like members 3 are mounted adjacent the bottom of the strainer 4 and are here illustrated as being in the form of a shaft provided with bristles, that is, in the form of a roller. The rollers 3 are mounted for rotation in the respective directions indicated by the arrows and are capable of very rapid rotation. It is assumed here that the rollers 3 are provided with steel bristles. As already mentioned earlier, it is also possible for the brush-like members 3 to be mounted for vibration.

The strainer 4 is closed off by a cover 7. The cover 7 serves as a deflecting or bounce plate, that is, the cover 7 is effective for causing particles impinging thereupon to rebound. Thus, the cover 7 may be of resilient construction. A feeding device 1, here illustrated as being in the form of a funnel, extends through the cover 7. The funnel 1 is for the purpose of introducing the material to be treated to the rollers 3 and it may be seen that the funnel 1 extends substantially to the periphery of the rollers 3 or, in other words, that the outlet end of the funnel 1 is located directly adjacent the rollers 3.

Turbulence chambers 8 are located above the rollers 3 being defined by the strainer 4, the cover 7 and the funnel 1. It will also be seen that the rollers 3 define with one another a gap. A bar 2 overlies the gap between the rollers 3 and covers this gap from above. The function of the bar 2 is to prevent the entry of the material to be treated into the gap between the rollers 3.

A conveying device 5, here shown as being in the form of a chute, extends below the perforate bottom of the strainer 4. The chute 5 has the purpose of conveying away the particles of desired size, for instance, regenerated foundry sand, which pass through the strainer 4. The latter is enclosed in a housing 9 which is provided with connections 6 for the purpose of removing dust-like material from the interior of the housing 9. The connections 6 may lead to a suitable suction or vacuum-producing device 10.

The operation of the arrangement will now be explained with reference to the regeneration of used foundry sand for illustrative purposes. Such used foundry sand is often in the form of lumps which include particles of the foundry sand per se as well as layers of a binder for the sand surrounding or coating the sand particles.

The material to be treated or, in other words, the used foundry sand, is admitted into the funnel 1. This material is present primarily in the form of irregular lumps. In this description, these lumps constitute starting particles and it will be understood that the term particles as used in this connection encompasses lumps. The lumps then fall or slide, as generally indicated by the arrow, into the region of the bristles of the rollers 3, which latter are assumed to be provided with highly abrasion-resistant steel bristles.

Here, the sand particles are separated from the lumps one by one and the surrounding layers of binder material undergo a first mechanical treatment. The separated sand particles are carried along downwardly by the bristles of the rollers 3 and are either pressed through the perforate bottom of the strainer 4 or may also be flung tangentially upwardly against the cover 7. In the latter event, the sand particles rebound back onto the inclined, perforate walls of the strainer 4 or, on the other hand, they may also come into renewed contact with ascending sand particles or agglomerates thereof. Should the latter be the case, the sand particles are cleansed anew in the combined rebound and turbulence chambers 8 by virtue of the rebounding effect and the abrasive or rubbing action to which they are subjected. The ascension of the sand particles in the chambers 8, the rebounding effect and the collisions between ascending and rebounding sand particles are all indicated by appropriate arrows.

The sand which falls through the strainer 4, as also shown by arrows, enters the chute 5 and is conveyed out of the apparatus. By virtue of the dust removal connections 6 of the housing 9, the interior of the latter is maintained at an underpressure. Consequently, as indicated by arrows, the dust-like material generated is sucked out of the housing 9 and, in this manner, the binder residues removed from the quartz or sand particles is separated from the latter. As mentioned previously, the bar 2 prevents the lumps of used sand from being drawn into the bristles or the rollers 3.

Figure 2:
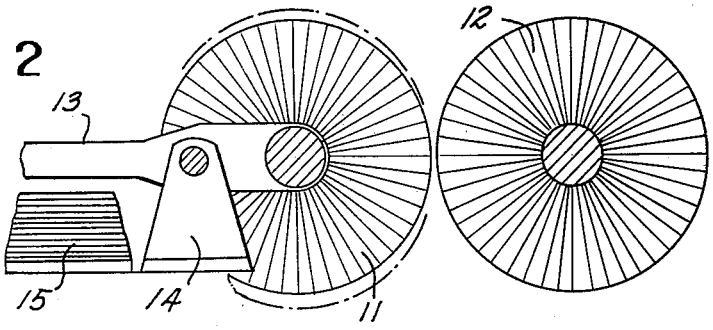
FIG. 2 is a view of a detail of the arrangement which may be used for vibrating a brush-like member.

Referring now to the FIG. 2, this indicates a manner in which at least one of the brush-like members may be mounted for vibration. It may be seen that a pair of brush-like members is shown which are identified by the reference numerals 11 and 12, respectively. The brush-like members 11 and 12 are here in the form of a shaft provided with suitable bristles. In the embodiment illustrated, the brush-like member 11 is mounted for vibration whereas the brush-like member 12 is fixedly mounted. The vibratory brush-like member 11 is secured to a lever 13 which, in turn, is pivotally mounted on a support block 14. A magnet 15 is arranged adjacent the lever 13. The lever 13 and the magnet 15 together constitute a means for imparting a vibratory motion to the brush-like member 11.

Figure 3:
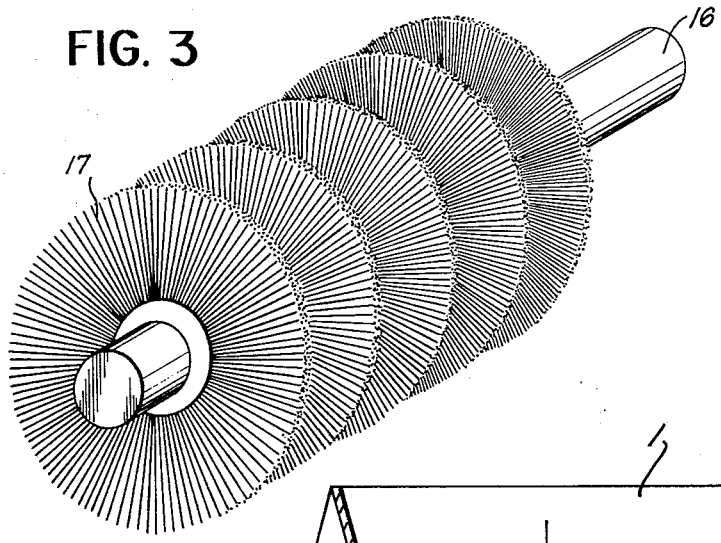
FIG. 3 is a perspective view of another detail of the arrangement.

Referring finally to the FIG. 3, this illustrates a manner of providing a brush-like member which is in the form of a support having disc-like brush elements removably mounted thereon. In the illustrated embodiment, the support is shown as being in the form of a shaft identified by the reference numeral 16. The disc-like brush elements are identified by the reference numeral 17 and several of these are provided on the shaft 16.

It will be understood that each of the elements described above, or two or more together, may also find a useful application in other types of processes and arrangements differing from the types described above.

While the invention has been illustrated and described as embodied in a regeneration of used foundry sand, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method for the regeneration of used foundry sand, particularly used foundry sand which is coated with a binder, comprising abrasively brushing used foundry sand so as to effect cleaning of the same; and propelling said used foundry sand against a bounce surface so as to permit rebounding of said used foundry sand and cleaning of the same by sand travelling towards said bounce surface.

2. A method as defined in claim 1, wherein the regeneration of said used foundry sand comprises a dry mechanical treatment and said brushing includes contacting said used foundry sand with at least one rotating, brush-like member propelling said used foundry sand against said bounce surface.

3. A method as defined in claim 2, wherein said member is vibrated.

4. A method as defined in claim 2, said brushing comprising contacting said used foundry sand with an additional brush-like member; and wherein said members are driven.

5. A method as defined in claim 1, said used foundry sand comprising lumps; and wherein said brushing comprises comminution of said lumps.

6. A method as defined in claim 2, wherein said one member is provided with steel bristles.

7. An arrangement for the regeneration of used foundry sand, particularly for the dry mechanical treatment of used foundry sand, comprising at least one brush-like member for the comminution and abrasive brushing of used foundry sand; means for feeding used foundry sand to said brush-like member; a strainer member extending by said brush-like member so that the latter is located on one side of said strainer member, said strainer member permitting the passage therethrough of particles having a size less than a predetermined size; means for collecting sand particles which have passed through said strainer member arranged on another side of the latter; and a bounce surface located on said one side of said strainer member so as to permit used foundry sand being regenerated and which is propelled in the direction of said bounce surface to rebound and undergo cleaning by sand traveling towards said bounce surface prior to passage of the used foundry sand through said strainer member.

8. An arrangement as defined in claim 7, said brush-like member including steel bristles and being mounted for rotation, and said feeding means comprising a feeding member of funnel-like configuration, said collecting means including a discharge member for discharging sand which has passed through said strainer member; further comprising a housing accommodating said brush-like and strainer members and at least partially surrounding said feeding and discharge members, said strainer member being of trough-like configuration and being arranged so as to divide said housing into an upper section containing said brush-like member and at least part of said feeding member and a lower section containing at least part of said discharge member, and said strainer member having a portion which is in close proximity to said brush-like member and another portion which includes an edge region remote from said brush-like member and which is spaced from said feeding member, said bounce surface extending substantially from said edge region to said feeding member.

9. An arrangement as defined in claim 8; further comprising suction means for withdrawing dust-like material from said housing.

10. An arrangement as defined in claim 7, said comprising another brush-like member provided with steel bristles, said brush-like members defining with one another a gap; and further comprising a bar member at least partially overlying said gap so as to prevent entry of particles having a size in excess of a predetermined size into said gap.

11. An arrangement as defined in claim 8, wherein said brush-like member is mounted for vibration.

12. An arrangement as defined in claim 7, comprising another brush-like member; and wherein at least one of said brush-like members comprises steel bristles, and at least one of said brush-like members includes a support and a plurality of disc-like brush elements removably mounted on said support.

13. An arrangement as defined in claim 7, wherein said collecting means comprises a conveying member for conveying sand which has passed through said strainer member from said brush-like member.

14. An arrangement as defined in claim 13, wherein said conveying member is operative for continuously conveying sand from said brush-like member.

* * * * *